US005397266A

United States Patent [19]

Nordin

[11] Patent Number: 5,397,266

[45] Date of Patent: Mar. 14, 1995

[54] RETAINING AND RELEASING DEVICE FOR EXHAUST-GAS EXTRACTION NOZZLE

[75] Inventor: Kurt L. Nordin, Helsingborg, Sweden

[73] Assignee: AB Ph. Nederman & Co., Helsingborg, Sweden

[21] Appl. No.: 86,881

[22] Filed: Jul. 7, 1993

[30] Foreign Application Priority Data

Jul. 13, 1992 [SE] Sweden ..... 9202153

[51] Int. Cl.[6] ..... F23J 11/02

[52] U.S. Cl. ..... 454/63; 104/52

[58] Field of Search ..... 104/52; 454/63, 64, 454/166, 167

[56] References Cited

U.S. PATENT DOCUMENTS

| | | | |
|---|---|---|---|
| 1,337,347 | 4/1920 | Devine | 104/52 |
| 5,092,228 | 3/1992 | Pfeiffer, Jr. et al. | 454/63 |
| 5,096,230 | 3/1992 | Pausch et al. | 285/9.1 |
| 5,162,017 | 11/1992 | Nordin | 454/63 |

FOREIGN PATENT DOCUMENTS

| | | |
|---|---|---|
| 8205662-3 | 11/1983 | Sweden . |
| 2128323 | 4/1984 | United Kingdom . |

*Primary Examiner*—Harold Joyce

*Attorney, Agent, or Firm*—Foley & Lardner

[57] ABSTRACT

A retaining and releasing device for an exhaust-gas extraction nozzle, which nozzle (5) is adapted for extracting exhaust gases from upwardly directed exhaust pipes (3 ) on vehicles, e.g. fire-fighting vehicles, when these vehicles are started and driven in premises for the vehicles, e.g. a fire station. To permit safe retention of the nozzle (5) at the exhaust pipe (3) with sufficient forces without the forces counteracting release of the exhaust pipe (3) from the nozzle (5), the retaining and releasing device includes at least one retaining and releasing arm (29) which is movable between a retaining position (D) wherein it permits retention of the exhaust-gas extraction nozzle (5) at the exhaust pipe (3) and a releasing position wherein it permits release of the exhaust pipe (3) from the nozzle (5), whereby a retaining device (43) is provided to retain the retaining and releasing arm (29) in its retaining position (D) and to release the arm (29) such that the arm can move to its releasing position when the exhaust-gas extraction nozzle (5) reaches a certain position in the premises (1).

14 Claims, 5 Drawing Sheets

RETAINING AND RELEASING DEVICE FOR EXHAUST-GAS EXTRACTION NOZZLE

The present invention relates to a retaining and releasing device for an exhaust-gas extraction nozzle, which nozzle is adapted for extracting exhaust gases from upwardly directed exhaust pipes on vehicles, e.g. fire-fighting vehicles, when these vehicles are started and driven in premises for said vehicles, e.g. a fire station, and which nozzle is movably mounted in said premises for being able to follow the vehicle when said nozzle is attached to the exhaust pipe of said vehicle, whereby the retaining and releasing device is adapted to permit attachment of the exhaust-gas extraction nozzle to the exhaust pipe such that said exhaust pipe can bring said nozzle with it when the vehicle is driven in the premises, and whereby said retaining and releasing device is further adapted to permit release of the exhaust-gas extraction nozzle from the exhaust pipe when required as the vehicle leaves the premises.

Retaining and releasing devices of the above type have already been described in our SE patent specification 8205662-3 (public specification 430 428). This prior art device has spring loaded catch arms which can yield to let the exhaust pipe into the nozzle and which can retain the nozzle at the exhaust pipe when the vehicle drives through the premises. For being able to do this, the springs must exert relatively great spring forces on the arms. The larger the spring forces, the better the nozzle is retained at the exhaust pipe when the vehicle drives through the premises, but great spring forces also provide a corresponding large resistance when the arms shall yield for the exhaust pipe when said pipe shall be released when the nozzle is stopped adjacent to the exit gate of the premises. This is a contrasting relationship that might cause problems which can not be solved with the prior art device.

The object of the present invention is to eliminate this drawback and provide a simple device in which the nozzle is safely retained at the exhaust pipe when this is required and in which said exhaust pipe can be released from the nozzle without the exhaust pipe thereby needing to overcome great resistance. This and other purposes are achieved according to the invention by means of the characterizing features of claim 1.

The device according to the invention permits e.g. that the retaining forces generated for retaining the nozzle at the exhaust pipe when the vehicle is driven through the premises, cease when the exhaust pipe shall be released from the nozzle, which means that great retaining forces can be used for retaining said nozzle at said exhaust pipe without said retaining forces creating a problem when the exhaust pipe is released from the nozzle.

The invention will be further described below with reference to the accompanying drawings, in which FIG. 1 is a side view of a retaining and releasing device according to the invention connected with the exhaust pipe of a vehicle;

Figure 1:
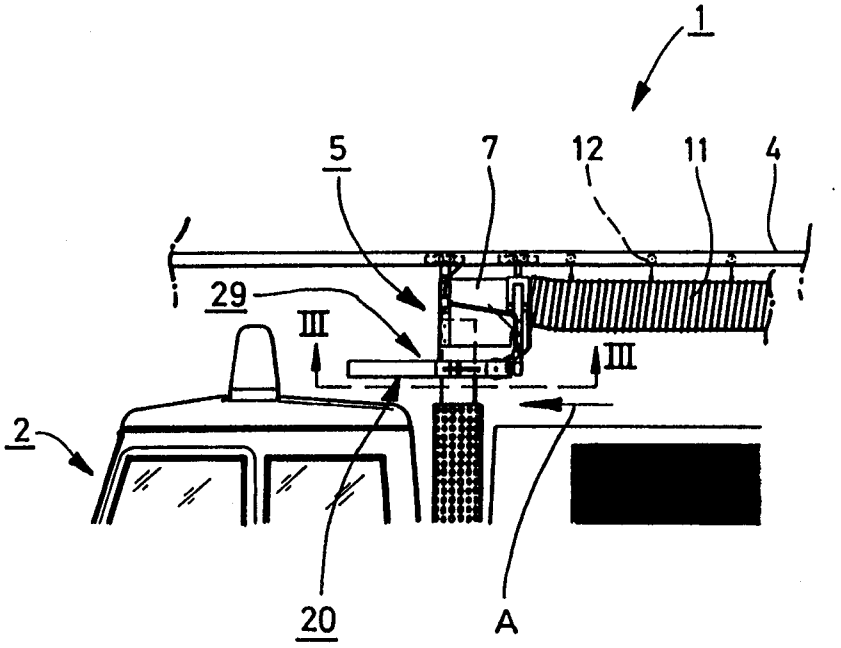
Figure 2:
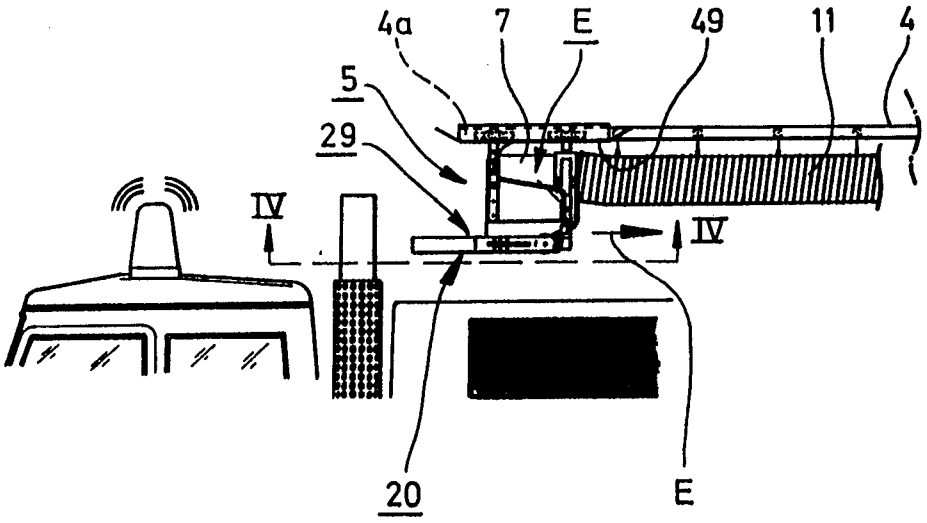
FIG. 2 is a side view of the retaining and releasing device of FIG. 1 after release of the exhaust pipe.

In the figures there is shown premises 1, e.g. in a fire station, in which vehicles 2, e.g. fire-fighting vehicles, with upwardly directed exhaust pipes 3 can be parked. At the top in the premises i there is mounted a rail 4 and this rail extends along an area wherein the vehicle shall be parked and driven. The rail 4 extends in a direction towards a gate (not shown) through which the vehicle 2 is driven into and out of the premises 1, whereby the rail 4 preferably terminates at or a distance within said gate. Furthermore, the rail 4 can be suspended (not shown) so that is can be moved laterally relative to its longitudinal direction such that the position thereof can be adapted to the vehicle 2 with regard to whether said vehicle is driven in and out through the middle of the gate or deviating there from and/or whether the vehicle 2 is driven obliquely into and out of the premises 1 instead of straight in or out.

An exhaust-gas extraction nozzle 5 is suspended in the rail 4 via traversing wheels 6 such that said nozzle 5 can be displaced along the rail 4 to a stop means **4*a*** at the front end portion of said rail.

The exhaust-gas extraction nozzle 5 preferably includes a hood 7 with a lower opening 8 and a front opening 9 for receiving the upwardly directed exhaust pipe 3 of the vehicle 2. The hood 7 has at the back an outlet pipe 10 through which the hood is connected with an exhaust-gas extraction hose 11. This hose is preferably suspended on the rail 4 via a plurality of running means 12 and the hose is designed such that is can be extended when the exhaust-gas extraction nozzle 5 is displaced in a direction towards the gate and contracted when the nozzle is displaced in the opposite direction. This exhaust-gas extraction hose 11 is adapted to lead away those exhaust gases that the exhaust pipe 3 discharges into the nozzle 5 preferably to a device (not shown) which can generate a negative pressure in the hose 11 and nozzle 5 and/or which permits purification of the exhaust gases before letting them out into the environment.

The front opening 9 in the hood 7, i.e. the in- and outlet for the exhaust pipe 3, is preferably sealed by means of two closing or cut-off flaps 13 and 14, consisting of elastic material and provided such that they can be opened by the exhaust pipe 3 when it passes and which due to their elasticity automatically return to their closing positions when said exhaust pipe has passed.

The hood 7 has a rear yoke 15 on which there is provided an upwardly directed bracket 16 for rear traversing wheels 6. The hood 7 further includes a front yoke 17 with an upwardly directed bracket 18 for front traversing wheels 6.

On the rear yoke 15 there is provided a mounting device 19 through which a retaining and releasing device 20 is mounted on the exhaust-gas extraction nozzle 5. This retaining and releasing device 20 is adapted to permit attachment of the exhaust-gas extraction nozzle 5 to the exhaust pipe 3 such that said pipe can drag along said nozzle along the rail 4 when the vehicle 2 drives in a direction A towards the gate in order to leave the premises 1. The retaining and releasing device 20 is also adapted to permit release of the exhaust pipe 3 from the exhaust-gas extraction nozzle 5 when said nozzle is stopped by the stop means **4*a* at the front end portion of the rail 4**.

The mounting device 19 for the retaining and releasing device 20 perferably comprises two vertically directed tubes 21, 22 of which one tube 21 is located on one side of the hood 7 and the other tube 22 on the opposite side of said hood. In each tube 21, 22 there is displaceably mounted a somewhat thinner tube 23 and 24 respectively, and these latter tubes 23, 24 protrude downwards from the tubes 21, 22 and are down below connected with each other through a transverse tube 25. By means of this construction, the retaining and releasing device 20 can be displaced in vertical direction relative to the hood 7 and the retaining and releasing device 20 can be locked in an advantageous height position by locking the tubes 23, 24 relative to the tubes 21, 22 by means of lock means 26, 27 provided on said latter tubes 21, 22.

A catch arm 28 and a retaining and releasing arm 29 are provided on the transverse tube 25. These arms 28, 29 are located horizontally and they extend in a forward direction from the transverse tube 25 a distance beyond the front portions of the hood 7. The rear parts of the catch arm 28 are attached to the transverse tube 25 through mounting means 30 and the front or fore parts of said catch arm are directed obliquely outwards/forwards relative to the hood 7 in order to define a catch portion 31 for the exhaust pipe 3. A mounting arm 32 is through mounting means 33 fastened to the transverse tube 25 and extends in forward direction therefrom in parallel with or substantially in parallel with the rear parts of the catch arm 28. A pivoting portion 34 of the retaining and releasing arm 29 is provided on the mounting arm 32 through a hinge or link 35 in such a way that said retaining and releasing arm 29 is pivotable about a vertical or substantially vertical axis of rotation 36 relative to said mounting arm 32, i.e. also relative to the hood 7.

The retaining and releasing arm 29 includes, located on one side or substantially on one side of the pivoting portion 34, a retainable part 37 and, on the other side or substantially on the other side of said pivoting portion 34, a retaining part 38. The retainable and retaining parts 37, 38 are provided preferably by bending portions of the retaining and releasing arm 29 so that an obtuse angle is formed between said parts 37, 38.

A catch portion 39 extends from the retaining part 38 of the retaining and releasing arm 29 and this catch portion 39 is directed obliquely forwards/outwards in a releasing position C relative to the hood 7 and it is adapted to define, along with the catch portion 31 of the catch arm 28, a conically tapering catch device 40 which is adapted to guide the exhaust-gas extraction nozzle 5 relative to the exhaust pipe 3 so that said nozzle 5 is located in an exhaust-gas extracting position B in relation thereto.

Besides being settable in vertical direction relative to the exhaust-gas extraction nozzle 5 by making the tubes 23, 24 adjustable in height, the arms 28, 29 are preferably also settable relative to each other for being able to vary their relative distance. This is accomplished while the arm 28 is longitudinally displaceable on and relative to the transverse tube 25 and fastenable in various positions thereto by means of the mounting means 30, and the mounting arm 32 is also mounted longitudinally displaceable on said transverse tube 25 and fastenable in various positions thereto by the mounting means 33.

Figure 3:
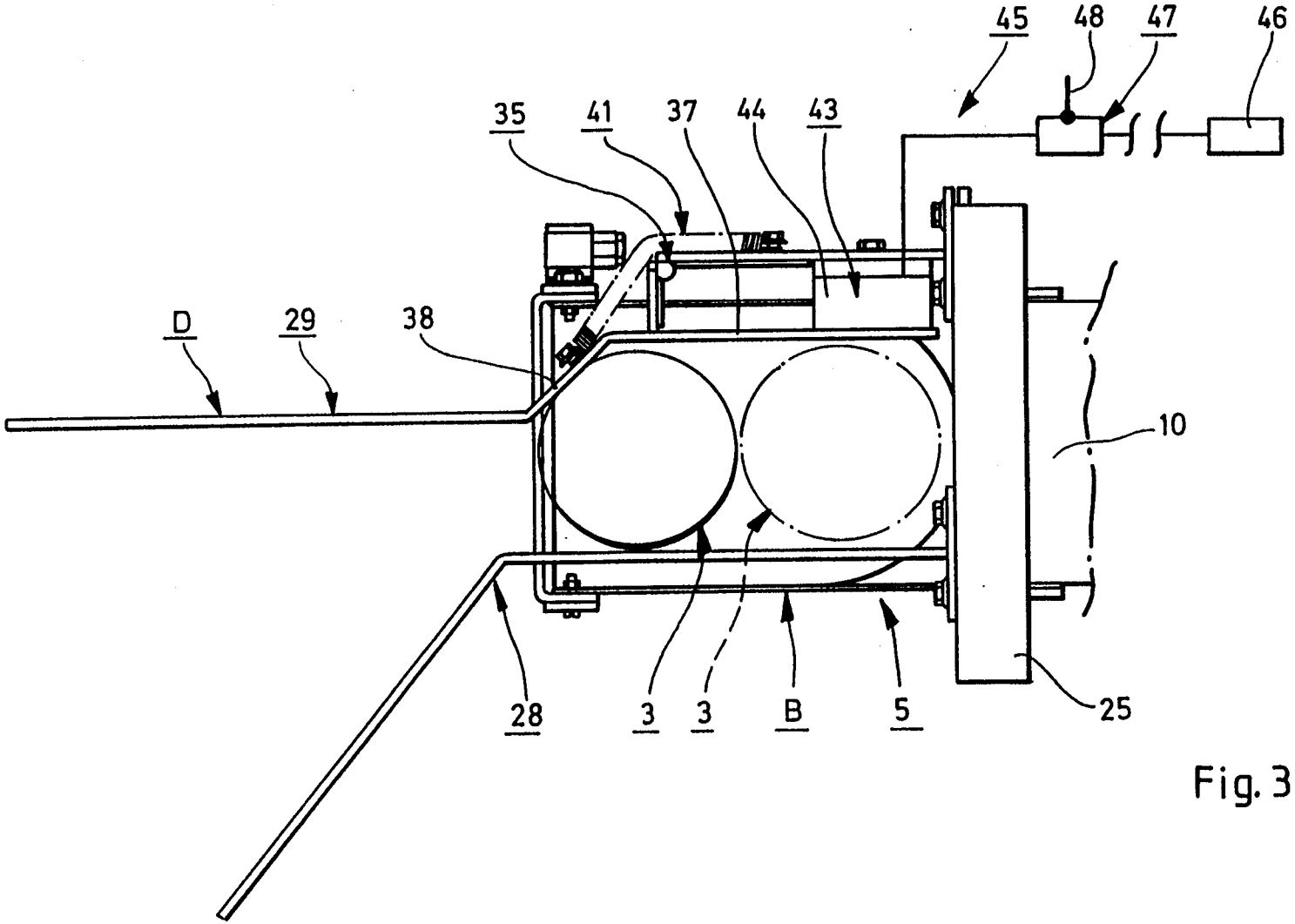
FIG. 3 is a view along the line III—III in FIG. 1.
Figure 4:
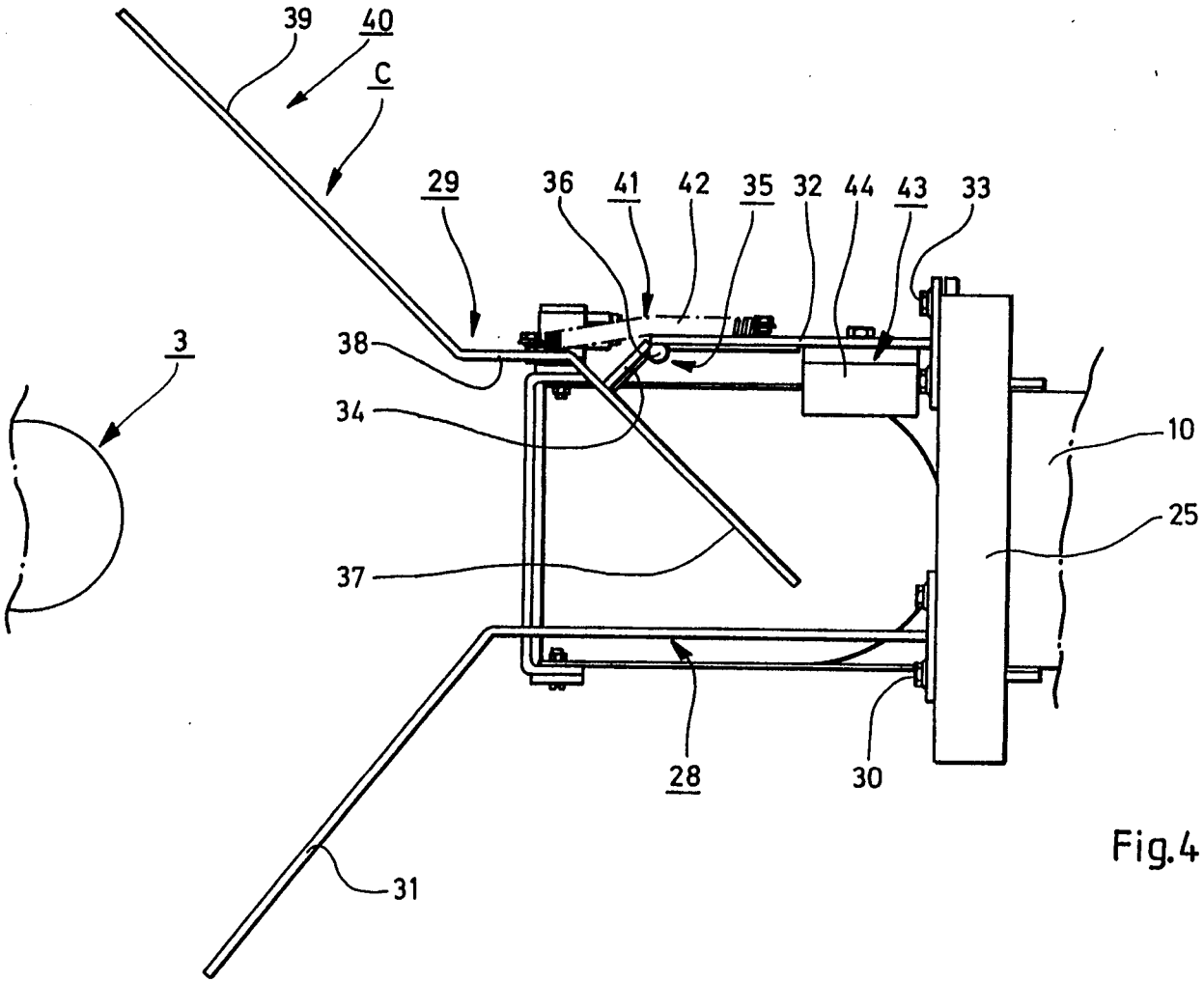
FIG. 4 is a view along the line IV—IV in FIG. 2.
Figure 5:
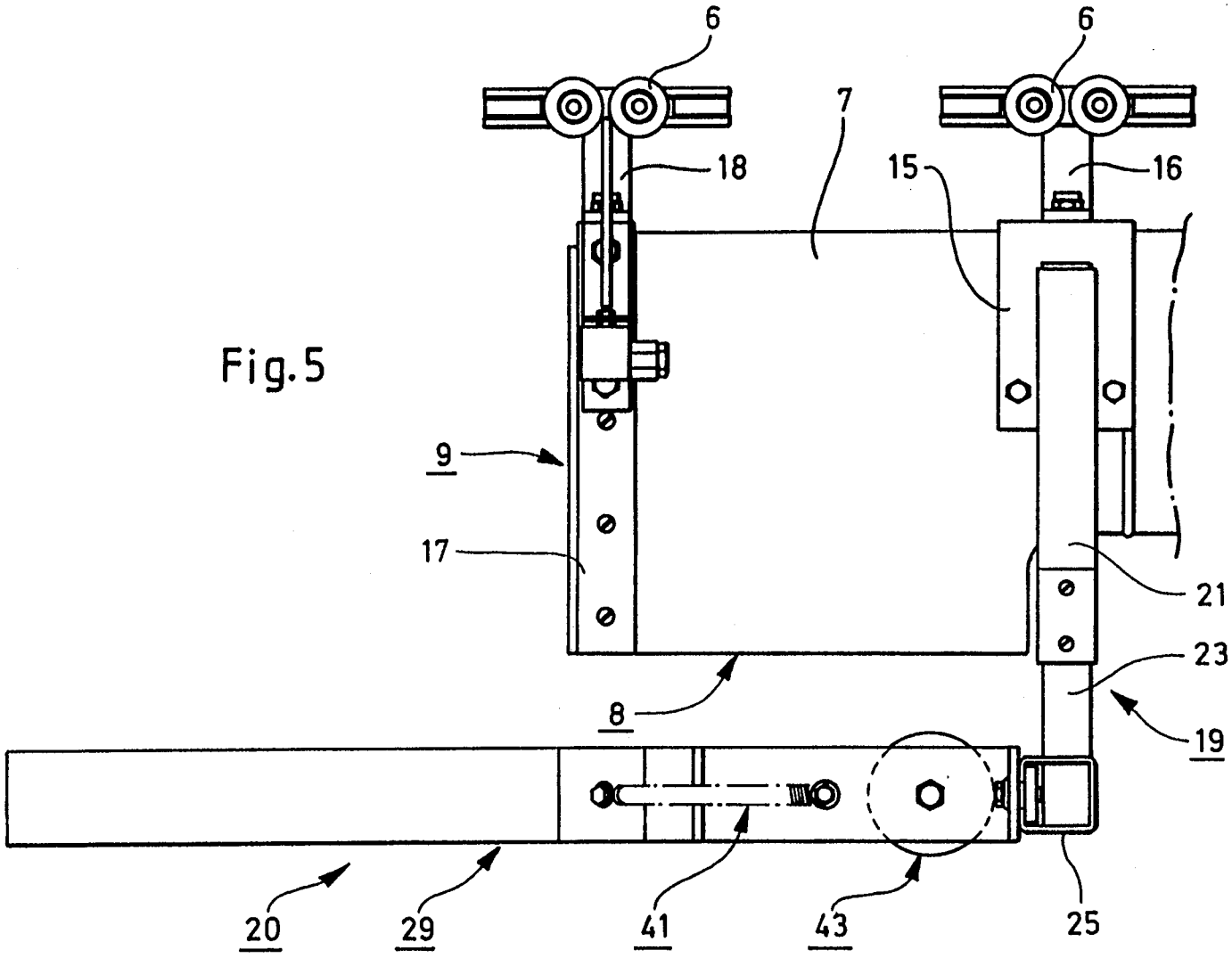
FIG. 5 is a side view of the retaining and releasing device of FIG. 1.
Figure 6:
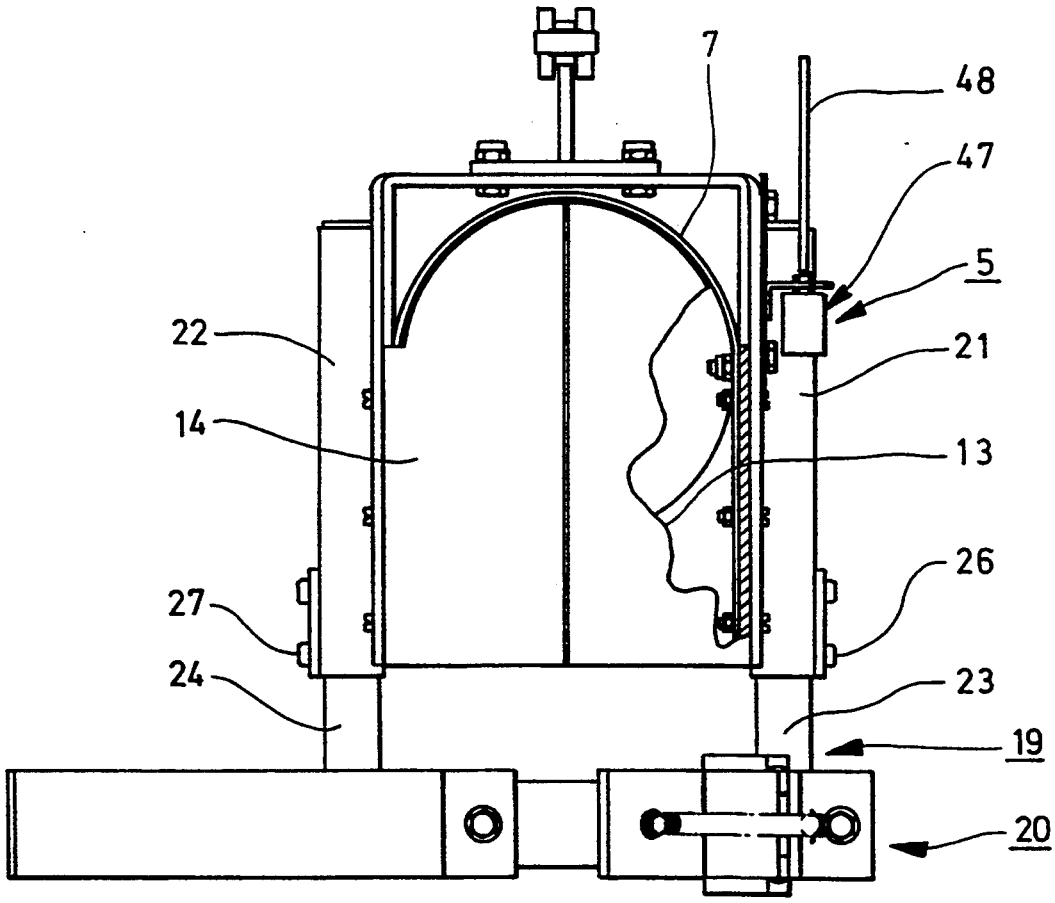
FIG. 6 is a front view of the retaining and releasing device of FIG. 1.

The retaining and releasing arm 29 preferably cooperates with at least one a neutral-position maintaining means 41, which is provided to return and hold the releasing arm 29 in a releasing position C (see FIG. 4). This neutral-position maintaining means 41 consists preferably of a spring means 42, e.g. a helical spring, one end of which is attached to the mounting arm 32 on one side of the hinge or link 35 while the other end is secured to the retaining part 38 of the retaining and releasing arm 29 on the other side of the link 35, such that said spring means 42 is stretched when said retaining and releasing arm 29 is pivoted from its releasing position C towards a retaining position D (FIG. 3).

The retaining and releasing device 20 also includes a retaining device 43 which is adapted to retain the retaining and releasing arm 29 in its retaining position D. This retaining device 43 preferably consists of at least one electromagnet 44 which is adapted to retain said retaining and releasing arm 29 in its retaining position D by magnetic force. The electromagnet 44 is preferably provided on the mounting arm 32 close to the transverse tube 25 such that the end portion of the retainable part 37 of the retaining and releasing arm 29 can engage said electromagnet. The electromagnet 44 forms part of an electric circuit 45 (schematically shown in FIG. 3), including a power supply 46 and a disconnecting device 47.

The disconnecting device 47 is mounted on the exhaust-gas extraction nozzle 5 and when said device is closed, the electromagnet 44 is activated. The disconnecting device 47 has a schematically illustrated contact member 48 which cooperates with a resetting device 49 located at the front end portion of the rail 4. This resetting device 49 is mounted such that it automatically resets the contact member 48 when the exhaust-gas extraction nozzle 5 is moved to a position E at the front end portion of the rail 4, so that the disconnecting device 47 disconnects or opens the electric circuit 45, whereby the electromagnet 44 is deactivated or inoperative when said nozzle 5 is in said position E at said end portion. While however the exhaust-gas extraction nozzle 5 is displaced backwards in the direction F from the position E, the contact member 48 is moved from its contact condition with the resetting device 49, whereby said contact member automatically returns to a position closing the electric circuit 45, such that the electromagnet 44 is once again operative or activated.

The device described above and illustrated in the drawings operates so that the exhaust-gas extraction nozzle 5 is set in the position E at the front end portion of the rail 4 such that it can be reached by the exhaust pipe 3 on a vehicle 2 driven into the premises 1. When the upwardly directed exhaust pipe 3 of the vehicle 2 reaches the exhaust-gas extraction nozzle 5, it will either move directly into said nozzle or through the catch device 40 guide said nozzle sideways (by moving the rail 4 sideways) until the exhaust pipe 3 can move into the nozzle 5.

When the exhaust pipe 3 moves into the exhaust-gas extraction nozzle 5, it is brought in contact with the retainable part 37 of the retaining and releasing arm 29 so that said arm is pivoted from its releasing position C to its retaining position D, whereby said retainable part 37 is brought in contact with the electromagnet 44 or reach a position in its vicinity. By abutting the rear portions of the exhaust-gas extraction nozzle 5, the exhaust pipe 3 will thereafter drag said nozzle 5 along with it in the direction F backwards into the premises 1 along the rail 4, while at the same time said nozzle reaches its extracting position B relative to said exhaust pipe. When the nozzle 5 hereby leaves the position E at the front end portion of the rail 4, the electromagnet 44 is activated, whereby it will retain the retaining and releasing arm 29 in its retaining position D.

When the vehicle 2 is parked in the premises 1, the exhaust-gas extraction nozzle 5 will be located in its extracting position B relative to the exhaust pipe 3 (see FIG. 1) so that exhausts from said exhaust pipe can be immediately extracted when the engine of the vehicle 2 is started. When this is done and the vehicle 2 is driven forward in the direction A in order to leave the premises 1, the exhaust pipe 3 will abut the retaining part 38, which thus, prevents said exhaust pipe from leaving the exhaust-gas extraction nozzle 5. By engaging the retaining part 38, the exhaust pipe 3 will drag the nozzle 5 along with it in forward direction along the rail 4 as the vehicle 2 moves forward in the direction A while at the same time said nozzle continuously maintains its extracting position B during this movement. The magnetic field generated by the electromagnet 44 thereby has such a retaining force that it is capable of retaining the retaining and releasing arm 29 in its retaining position D also when said arm is affected by oppositely directed forces that are generated during the movement of the exhaust-gas extraction nozzle 5 and exhaust-gas extraction hose 11 along the rail 4 and the extension of said hose in longitudinal direction.

When the exhaust pipe 3 has moved the exhaust-gas extraction nozzle 5 to the position E at the front end portion of the rail 4, the electromagnet 44 is deactivated as defined above, which means that the retaining force on the retaining and releasing arm 29 ceases. This means in turn that the exhaust pipe 3 can leave the nozzle 5 by pivoting the arm 29 to the releasing position C, wherein said arm releases said exhaust pipe 3, while the forward movement of the nozzle is stopped by the stop means 4*a*.

The invention is not limited to the embodiment described above and illustrated in the drawings. As alternative embodiments, the exhaust-gas extraction nozzle 5, mounting device 19, catch arm 28 and retaining and releasing arm 29 can be designed differently than shown; the retaining device 43 can be of another type than an electromagnet 44 and it can be operated in other ways than with the remote control described. It can also be mentioned finally, that if the retaining device 43 includes an electromagnet 44, the arm 29 can be made of a material which is affected by the magnetic force. Alternatively, the arm 29 may consist of another material completed with magnetically affectable portions.

I claim:

1. Retaining and releasing device for an exhaust-gas extraction nozzle, which nozzle (5) is adapted for extracting exhaust gases from upwardly directed exhaust pipes (3) on vehicles (2) when these vehicles are started and driven in premises (1) for said vehicles and which nozzle (5) is movably mounted in said premises (1) for being able to follow the exhaust pipe (3) of the vehicle (2) when said nozzle is attached thereto, whereby the retaining and releasing device (20) is adapted to permit attachment of the exhaust-gas extraction nozzle (5) to the exhaust pipe (3) such that said exhaust pipe (3) can bring said nozzle (5) with it when the vehicle (2) is driven in the premises (1), and whereby said retaining and releasing device (20) is further adapted to permit release of the exhaust-gas extraction nozzle (5) from the exhaust pipe (3) when required as the vehicle (2) leaves the premises (1), characterized in that the retaining and releasing device (20) includes at least one retaining and releasing arm (29) which is movable between a retaining position (D) wherein it permits retention of the exhaust-gas extraction nozzle (5) at the exhaust pipe (3) and a release position (C) wherein it permits release of said exhaust pipe (3) from said nozzle (5), whereby a retaining device (43) is provided to retain the retaining and releasing arm (29) in its retaining position (D) and to release the arm (29) such that said arm can move to its releasing position (C) when the exhaust-gas extraction nozzle (5) reaches a certain position (E) in the premises (1), the retaining device (43) comprising an electromagnet (44) retaining the retaining and releasing arm (29) in the retaining position (D) by means of magnetic force, the electromagnet (44) being remote-controlled to release the retaining and releasing arm (29) by cessation of its magnetic force when the exhaust-gas extraction nozzle (5) reaches a certain position (E) as the vehicle (2) is driven out of the premises (1), whereby the exhaust pipe (3) can be released from the nozzle (5) when the nozzle is prevented from continuing its movement in the same direction as the vehicle (2).

2. Retaining and releasing device according to claim 1, characterized in that the retaining and releasing arm (29) is displaceable relative to its retaining position (D) under the influence of the exhaust pipe (3) when said pipe is moved into the exhaust-gas extraction nozzle (5) and that the retaining and releasing arm (29) is further moveable to its releasing position (C) under the influence of the exhaust pipe (3) when the retaining device (43) releases said pipe.

3. Retaining and releasing device according to claim 1, characterized in that the retaining and releasing arm (29) is pivotally mounted relative to the exhaust-gas extraction nozzle (5) about a vertical or substantially vertical axis of rotation (36) such that said arm can pivot between its retaining position (D) and its releasing position (C).

4. Retaining and releasing device according to claim 1 characterized in that the retaining and releasing arm (29) includes a retainable part (37) which under the influence of the exhaust pipe (3) when said pipe moves into the exhaust-gas extraction nozzle (5), is displaceable to cooperate with the retaining device (43) that to retain the retainable part (37), whereby the retaining and releasing arm (29) further includes a retaining part (38) which is rigidly connected with the retainable part (37), which is moveable to the retaining position (D) so that said retainable part is displaced to cooperation with the retaining device (43), and which retains the exhaust-gas extraction nozzle (5) at the exhaust pipe (3) by preventing said exhaust pipe from leaving an exhaust-gas extracting position (B) relative to said nozzle when the retaining device (43) retains the retainable part (37).

5. Retaining and releasing device according to claim 4, characterized in that the retainable part (37) and the retaining part (38) are defined by two members of the retaining and releasing arm (29) which form an obtuse angle relative to each other.

6. Retaining and releasing device according to claim 3, characterized in that the retaining and releasing arm (29) includes a pivoting portion (34) through which the arm is connected with a hinge or link (35) about which said arm is pivotable, that the retainable part (37) at least partially is located on one side of this pivoting portion (34) and that the retaining part (38) at least partially is located on the other side of said pivoting portion.

7. Retaining and releasing device according to claim 1, characterized in that the retaining and releasing arm (29) cooperates with at least one neutral-position maintaining means (41), in the form of spring means (42)

which is mounted to hold the releasing arm (29) in the releasing position (C).

8. Retaining and releasing device according to claim 1, characterized in that the retaining and releasing arm (29) includes a catch portion (39) which, together with a corresponding catch portion (31) on a catch arm (28), defines a conically tapering catch device (40) which is adapted to guide the exhaust-gas extraction nozzle (5) relative to the exhaust pipe (3) such that said nozzle is located in an extraction position (B) in relation thereto.

9. Retaining and releasing device according to claim 8, characterized in that the retaining and releasing arm (29) and the catch arm (28) are provided on a mounting device (19) which is provided on the exhaust-gas extraction nozzle (5) and located beneath said nozzle, that said arms (28, 29) are mounted on the mounting device (19) and being movable in the vertical direction relative to the nozzle (5) and said arms (28, 29) being further mounted on said mounting device (19) such that they are settable in relation to each other for adjustment of their relative distance.

10. Retaining and releasing device according to claim 1, characterized in that the electro-magnetic (44) and the retaining and releasing arm (29) are mounted relative to each other such that the arm can be displaced by the exhaust pipe (3) to such a retaining position (D) wherein said arm is retained by means of the magnetic field generated by the electromagnet.

11. Retaining and releasing device according to claim 1, characterized in that the electromagnet (44) is fed through an electric circuit (45) comprising a disconnecting device (47) which is provided to open said electric circuit and thus, deactivate the electromagnet, when the exhaust-gas extraction nozzle (5) during its movement in the premises (1) reaches a position (E) wherein the exhaust pipe (3) shall be released, such that the electromagnet (44) thereby releases the retaining and releasing arm (29).

12. Retaining and releasing device according to claim 3, characterized in that the retainable part (37) of the retaining and releasing arm (29) comprises material affected by the electromagnet (44).

13. Retaining and releasing device according to claim 9, characterized in that the electromagnet (44) is mounted on the mounting device (19), on a mounting arm (32) thereof to which the retaining and releasing arm (29) is pivotally connected.

14. Retaining and releasing device according to claim 1, characterized in that the exhaust-gas extraction nozzle (5) has traversing wheels (6) through which the nozzle is suspended on a rail (4) provided at the top of the premises (1) such that said nozzle is movable along said rail, that the exhaust-gas extraction nozzle (5) at a front opening (9) has an inlet and outlet for the exhaust pipe (3), which front opening preferably is provided with cut-off flaps (13, 14) of an elastic material, whereby said flaps can be opened by the exhaust pipe (3) and due to their elasticity automatically return to closing position when said exhaust pipe has passed, that the exhaust-pipe extraction nozzle (5) is connected with an exhaust-gas extraction hose (11) of such type that it can be extended by being stretched when the nozzle (5) moves in one direction in the premises (1) and contracted when said nozzle is displaced in opposite direction, that the exhaust-gas extraction hose (11) at several locations through running means (12) is suspended on the same rail (4) as the nozzle (5) and that the retaining device (43) is mounted to retain the retaining and releasing arm (29) in a retaining position (D) when said arm is affected by forces generated because of the movement of said nozzle and said hose along the rail and because of the stretching of the hose due to this movement.

* * * * *